US006712407B2

(12) United States Patent
Duriez

(10) Patent No.: US 6,712,407 B2
(45) Date of Patent: Mar. 30, 2004

(54) LOCK FOR A MOTOR VEHICLE OPENING LEAF WITH A DISENGAGEABLE WRIST PIN

(75) Inventor: Laurent Duriez, Abbeville (FR)

(73) Assignee: Valeo Securite Habitacle, Creteil (FR)

( * ) Notice: Subject to any disclaimer, the term of this patent is extended or adjusted under 35 U.S.C. 154(b) by 0 days.

(21) Appl. No.: 10/078,387

(22) Filed: Feb. 21, 2002

(65) Prior Publication Data

US 2002/0113444 A1 Aug. 22, 2002

(30) Foreign Application Priority Data

Feb. 22, 2001 (FR) ..... 01 02415

(51) Int. Cl.[7] ..... E05C 3/06
(52) U.S. Cl. ..... 292/201; 292/DIG. 23
(58) Field of Search ..... 292/201, DIG. 62, 292/341.16, DIG. 23; 49/280

(56) References Cited

U.S. PATENT DOCUMENTS

| | | | | | |
|---|---|---|---|---|---|
| 3,722,644 | A | * | 3/1973 | Steinhagen | 192/56.57 |
| 4,046,237 | A | * | 9/1977 | Root et al. | 192/13 R |
| 4,174,621 | A | * | 11/1979 | Woltjen | 464/36 |
| 4,373,923 | A | * | 2/1983 | Kilwin | 464/36 |
| 4,727,301 | A | * | 2/1988 | Fulks et al. | 292/DIG. 23 |
| 4,796,932 | A | * | 1/1989 | Tame | 292/112 |
| 4,905,532 | A | * | 3/1990 | Fukumoto et al. | 185/40 R |
| 5,002,322 | A | * | 3/1991 | Fukumoto | 292/142 |
| 5,186,077 | A | * | 2/1993 | Nakane | 74/574 |
| 5,577,870 | A | * | 11/1996 | Nakamura | 411/402 |
| 5,649,726 | A | | 7/1997 | Rogers, Jr. et al. | |
| 5,738,189 | A | * | 4/1998 | Bennett et al. | 188/196 BA |
| 5,967,934 | A | * | 10/1999 | Ishida et al. | 475/269 |
| 6,051,901 | A | * | 4/2000 | Ishida | 411/7 |
| 6,102,454 | A | | 8/2000 | Weyerstall | |
| 6,206,784 | B1 | * | 3/2001 | Kato | 464/36 |

FOREIGN PATENT DOCUMENTS

| | | |
|---|---|---|
| DE | 90 12 785 U | 1/1991 |
| EP | 0 170 577 A | 2/1986 |
| GB | 2 276 416 A | 9/1994 |

* cited by examiner

*Primary Examiner*—J. J. Swann
*Assistant Examiner*—Thomas Ho
(74) *Attorney, Agent, or Firm*—Liniak, Berenato & White

(57) ABSTRACT

The lock for a motor vehicle opening leaf including a wheel (RD) to be driven in rotation about an axis (A1) under the action of an electric motor, the wheel driving in rotation a wrist pin (MT), the wrist pin (MT) collaborating with a member to opening said lock upon rotation of said motor. The wrist pin (MT) is secured to a plate (PT) which is mounted so that it can rotate about the axis (A1), and includes a first and a second associated member for coupling the plate (PT) and the wheel (RD). The first and second members contain a drive peg and an associated groove (RO) in the form of an arc of a circle, so that the wrist pin (MT) is free to turn about the axis (A1) through a certain angle. Thus, the lock can be opened manually when its motor fails.

2 Claims, 2 Drawing Sheets

LOCK FOR A MOTOR VEHICLE OPENING LEAF WITH A DISENGAGEABLE WRIST PIN

BACKGROUND OF THE INVENTION

1. Field of the Invention

The invention relates to a lock for a motor vehicle opening leaf, comprising a wheel intended to be driven in rotation about an axis under the action of an electric motor, said wheel driving in rotation a wrist pin, said wrist pin collaborating with a member for opening said lock so as to move it from a rest position to an open position upon rotation of said motor.

The invention applies more specifically to vehicle tailgate and trunk locks which comprise electric assistance capable of initiating opening of the trunk. These locks generally comprise a lock cylinder intended to take a key and a handle for opening the trunk by hand, and are designed so that when the user unlocks the lock, the electrical assistance also causes the trunk to open. More specifically, these locks generally comprise an intermediate opening member that can be actuated manually when the user actuates the handle, or electrically, for example via a wrist pin set in motion by an electric motor.

2. Description of Related Art

Known from the prior art is a lock of this type in which the wrist pin is secured to a toothed wheel which is driven by the electric motor. The problem with this lock is that in the event of motor failure or a break in the electric power supply occurring during assisted opening, the wrist pin is then immobilized in an intermediate position. This wrist pin consequently jams the opening member in a position for which the trunk is not necessarily open. It is then impossible for the user to open his trunk by operating the handle until the lock has been repaired or until the electrical supply failure has been solved.

The purpose of the invention is to overcome this drawback by proposing a lock which does not prevent the trunk from being opened, even when its electric actuator is immobilized in an intermediate position.

SUMMARY OF THE INVENTION

To this end, the subject of the invention is a lock for a motor vehicle opening leaf, comprising a wheel intended to be driven in rotation about an axis under the action of an electric motor, said wheel driving in rotation a wrist pin, said wrist pin collaborating with a member for opening said lock so as to move it from a rest position to an open position upon rotation of said motor, characterized in that said wrist pin is secured to a plate, said plate being mounted so that it can rotate about said axis, and in that it comprises a first and a second associated member for coupling the plate and the wheel in terms of rotation, these members being borne respectively by the wheel and by the plate, said first and second members comprising a drive peg and an associated groove in the form of an arc of a circle so that said wrist pin is free to turn about said axis through a certain angle to prevent said opening member from jamming in the event of failure of said motor.

Such a construction means that in the event of the motor failing in an intermediate position, the wrist pin is still free to rotate through half a turn, so that the opening member has enough mobility for the user to be able to actuate the trunk handle and succeed in opening it.

According to a preferred embodiment of the invention, the lock further comprises a torque limiter connecting in terms of rotation the toothed wheel to said plate, so that said plate positions itself in a stable manner in a neutral position for which said wrist pin is uncoupled from the member in the event of failure of said motor. With this arrangement, the fact of actuating the lock manually when its motor has failed configures this lock in manual mode for which it can be opened and closed manually indefinitely.

According to yet another particular embodiment of the invention in which the torque limiter comprises a spherical stop arranged in said face of said toothed wheel, and a number of spherical holes defining a circle in a corresponding face of said plate, said spherical holes being intended to accommodate said spherical stop. With this arrangement, the torque limiter is included in the plate and the toothed wheel, which makes it possible to reduce the cost of manufacture of the entity.

The invention will now be described in greater detail and with reference to the appended drawings which illustrate one non-limiting exemplary embodiment thereof.

DETAILED DESCRIPTION OF THE PREFERED EMBODIEMENT

Figures 1, 2, 3:
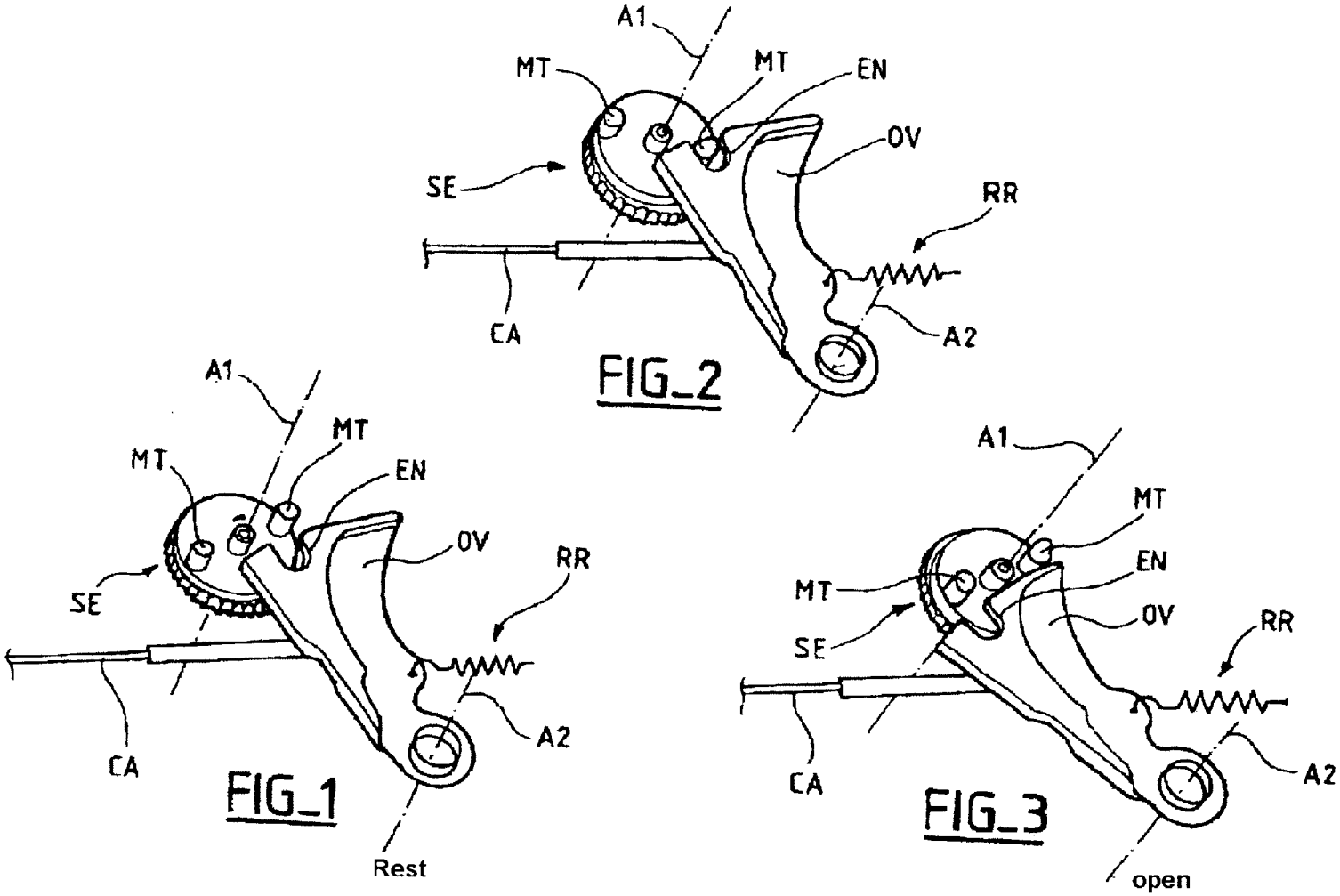
FIG. 1 is a partial depiction of the lock in the rest position.
FIG. 2 is a partial depiction of the lock in the process of opening.
FIG. 3 is a partial depiction of the lock in the open position.

The lock according to the invention comprises an opening member OV capable of turning about an axis A2 to initiate opening of the lock when it is moved from a rest position visible in FIG. 1 to an open position visible in FIG. 3. This opening member OV has the form of a roughly flat arm with its axis of rotation A2 at a first end, and having a notch EN at a second end. It can be moved via a cable CA or via a drive system acting on its notch EN at the second end. The cable CA is connected to an external lock handle so that action by a user on this external handle pulls on the cable CA to manually initiate opening of the trunk by moving the opening member OV into an open position. The drive system acting on the notch is moved by an electric motor, not depicted, and in particular comprises a wrist pin MT that can move in terms of rotation about an axis A1 and is capable of engaging in the notch EN as visible in FIG. 2 so as to move the member OV to the open position visible in FIG. 3 upon rotation of the electric motor. This drive system is generally known by the term electrically-assisted opening, and allows the user to open the trunk from his vehicle without having to act on the manual opening handle. More specifically, when the lock is opened by the drive system, the wrist pin MT makes a half revolution during which it engages in the notch EN to convey the opening member OV from the rest position to the open position when it disengages from the notch EN. When the wrist pin disengages from the notch EN, the member OV returns to a position corresponding to the lock open position under the effect of a return spring RR.

In the event of the motor failing in an intermediate position such as the position in FIG. 2 in which the wrist pin is engaged in the notch, this wrist pin MT is still able to move in rotation. Thus, the opening member OV is not jammed in the intermediate position, and the trunk can still be opened manually.

Figure 4:
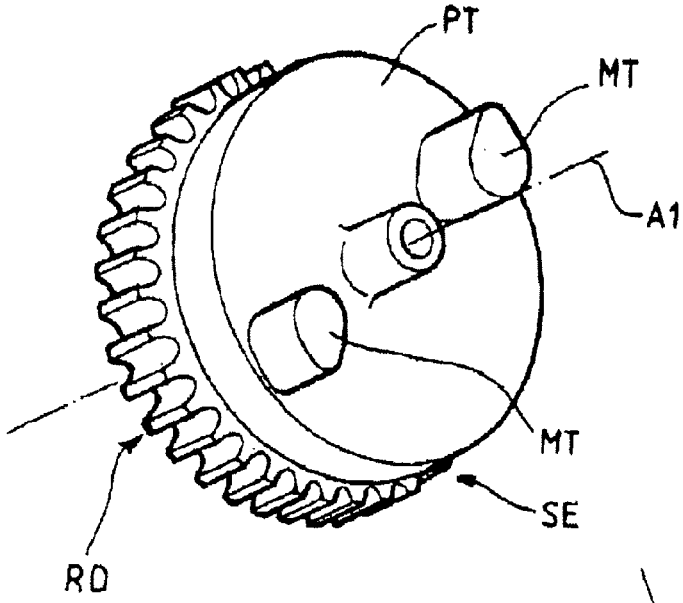
FIG. 4 is a perspective view of the toothed wheel and of the wrist pin.

As visible in FIG. 4, the drive system SE comprises a toothed wheel RD which can turn about an axis A1, and a plate PT in the form of a disk which can also turn about an axis A1, and which here supports two wrist pins MT intended to actuate the member OV in turn. The toothed wheel is driven in rotation by a motor, not depicted, for example via a worm, and is pressed against the plate so as to form a compact entity. More specifically, the toothed wheel is connected in terms of rotation to the plate PT while at the same time leaving this plate free to turn with respect to the toothed wheel to a certain angle equal, for example, to half a turn, this freedom of movement being achieved through first and second associated members for coupling the plate and the wheel in terms of rotation. In this instance, the first coupling member is secured to the plate and the second is secured to the toothed wheel, but the opposite arrangement is also possible.

Figure 5:
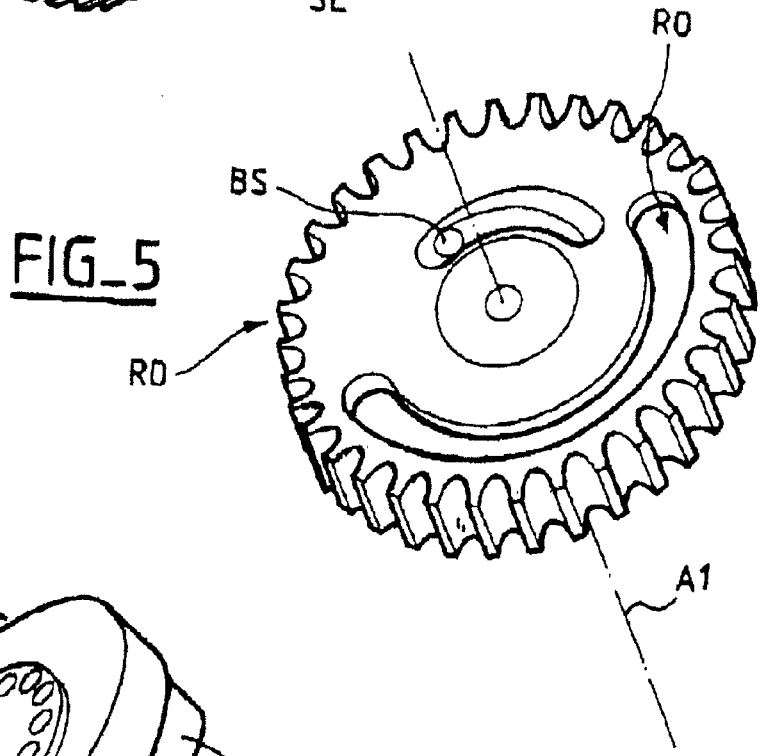
FIG. 5 is a perspective view of the toothed wheel alone.
Figure 6:
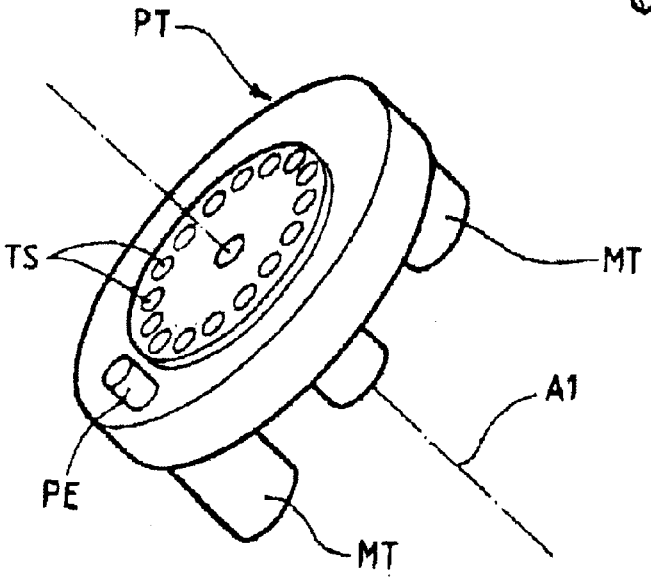
FIG. 6 is a perspective view of the plate alone.

As visible in FIG. 5, this toothed wheel RD comprises, on one of its faces, an oblong groove RO which defines an arc of a circle on this face. This groove accommodates a drive peg PE secured to the plate visible in FIG. 6 and allowing the toothed wheel to drive the plate in terms of rotation. When the toothed wheel is driven in rotation, one end of the groove RO reaches the peg PE and this in turn drives the plate PT in rotation. This drive peg PE can also move along the groove RO so that the plate is free to turn through a certain angle with respect to the toothed wheel. In this instance, the angle chosen is equivalent to half a turn, and the arc of a circle defined by the groove is a semicircle.

In the event of the motor failing during opening, this occurring for example when the wrist pin MT is engaged in the notch EN, the user can still actuate the lock handle manually to pull on the cable CA, and this has the effect of pulling on the wrist pin via the opening member. In a conventional lock for which the wrist pin is secured to the toothed wheel, the opening member is jammed by the wrist pin, and the action by the user does not move this opening member. With the lock according to the invention, when the user actuates the handle, the opening member pulls on the wrist pin to cause it to complete its travel using the half turn still available between the plate PT and the toothed wheel RD, which allows the member OV to reach the open position.

As an alternative, the lock according to the invention will also comprise a torque limiter associating the movements of the plate PT and of the toothed wheel RD. This torque limiter has the purpose of stabilizing the plate in a neutral position in the event of lock motor failure. More specifically, in the event of failure, when the user actuates the lock handle manually, the wrist pin MT is returned to a neutral position corresponding to the position visible in FIGS. 1 and 3 for which it is not engaged in the notch EN, which means that in this neutral position it does not interfere with the opening member OV. The torque limiter makes it possible to keep the plate in this neutral position so that the wrist pin does not drop back into the notch EN when the user releases the lock handle. Without a torque limiter, the wrist pin MT could drop back into the notch EN and prevent the opening member OV from returning to the rest position, and this member would once again become jammed in the intermediate position corresponding, for example, to that of FIG. 2.

In this alternative form, the torque limiter may comprise a spherical stop BS arranged in the toothed wheel at the face comprising the oblong groove, this spherical stop being intended to rest, at the same time exerting pressure along the axis A1, in the complementary spherical holes TS arranged in the corresponding face of the plate PT. More specifically, the spherical holes TS will then be arranged in a circle centered on the axis A1, so that during a relative movement of the plate with respect to the toothed wheel, the spherical stop BS will pass from one hole to the next and keep the plate in the current position when the movement stops. This spherical stop may, for example, be mounted on a leaf acting as a spring so as to make the relative movement of the plate PT with respect to the toothed wheel RD easier. With this arrangement, the torque limiter is incorporated into the plate and the toothed wheel, making it possible to reduce the cost of manufacture of the entity.

The invention is not restricted to trunk locks and may be adapted to suit other types of lock such as motor vehicle door locks, for example.

What is claimed is:

1. A lock for a motor vehicle opening leaf, comprising a wheel (RD) intended to be driven in rotation about an axis (A1) under the action of an electric motor so as to move, via a wrist pin (MT), an opening member (OV) from a closed position to an open position, said wrist pin (MT) being secured to a plate (PT) mounted so that it can rotate about said axis (A1), said lock further comprising a first and a second associated member for coupling the plate (PT) and the wheel (RD) in terms of rotation, these associated members being borne respectively by the wheel and by the plate, said first and second associated members comprising a drive peg (PE) and an associated groove (RO) in the form of an arc of a circle, so that said wrist pin (MT) is free to turn about said axis (A1) through a certain angle to avoid jamming of said opening member in the event of failure of said motor, characterized in that said plate (PT) is also connected in terms of rotation to said wheel (RD), wherein said wheel (RD) is toothed, by a torque limiter so that said plate positions itself in a stable way in a neutral position for which the wrist pin (MT) is uncoupled from the opening member (OV) in the event of failure of said motor.

2. The lock according to claim 1, in which said torque limiter comprises a spherical stop (BS) and a number of associated housings (TS) defining a circle, said housings being intended to accommodate said spherical stop (BS).

* * * * *